US008297702B2

(12) United States Patent
Costaglia

(10) Patent No.: US 8,297,702 B2
(45) Date of Patent: Oct. 30, 2012

(54) TWO POSITION AT-REST SEAT ADJUSTMENT MECHANISM

(75) Inventor: Massimo Costaglia, San Giustina in Colle (IT)

(73) Assignee: L & P Property Management Company, South Gate, CA (US)

( * ) Notice: Subject to any disclaimer, the term of this patent is extended or adjusted under 35 U.S.C. 154(b) by 328 days.

(21) Appl. No.: 12/593,210

(22) PCT Filed: Mar. 27, 2008

(86) PCT No.: PCT/US2008/058415

§ 371 (c)(1),
(2), (4) Date: Mar. 23, 2010

(87) PCT Pub. No.: WO2008/119010

PCT Pub. Date: Oct. 2, 2008

(65) Prior Publication Data

US 2010/0194161 A1 Aug. 5, 2010

(30) Foreign Application Priority Data

Mar. 27, 2007 (IT) ..... CR2007A0007

(51) Int. Cl.
*A47C 1/032* (2006.01)

(52) U.S. Cl. ..... 297/313; 297/300.1; 297/302.1; 297/328

(58) Field of Classification Search ..... 297/300.1, 297/302.1, 313, 328, 337
See application file for complete search history.

(56) References Cited

U.S. PATENT DOCUMENTS

| | | | | |
|---|---|---|---|---|
| 4,099,775 | A * | 7/1978 | Mizelle | 297/302.3 |
| 4,198,094 | A * | 4/1980 | Bjerknes et al. | 297/300.4 |
| 4,915,449 | A * | 4/1990 | Piretti | 297/326 |
| 5,029,940 | A * | 7/1991 | Golynsky et al. | 297/300.4 |
| 5,333,368 | A * | 8/1994 | Kriener et al. | 297/302.1 |
| 6,283,549 | B1 | 9/2001 | Husemann | |
| 6,419,320 | B1 | 7/2002 | Wang | |
| 6,588,843 | B1 | 7/2003 | Ebenstein | |
| 6,588,844 | B1 * | 7/2003 | Stenzel | 297/300.2 |
| 6,840,578 | B1 * | 1/2005 | Su | 297/302.3 |
| 2005/0280301 | A1 * | 12/2005 | Freed et al. | 297/337 |

FOREIGN PATENT DOCUMENTS

EP 1576905 * 9/2005

* cited by examiner

*Primary Examiner* — Peter R. Brown
(74) *Attorney, Agent, or Firm* — Shook Hardy & Bacon LLP

(57) ABSTRACT

This invention is directed to a two-position, at rest, seat angle adjustment assembly that locks the seat in two distinct positions. In a first position, the seat is generally horizontal, while in a second position, the seat is inclined at an angle relative to horizontal. The assembly includes left and right adjustment mechanisms, a rod, and a lever. The left and right adjustment mechanisms are mounted to the seat and the back assembly on each side thereof. Each of the mechanisms includes a housing, and a cam. The cam is received in the housing and the rod is fixably received within the cam. The lever is attached to the rod proximate the right adjustment mechanism. The lever is utilized to rotate the cams within their respective housings thereby moving the seat with respect to the back assembly.

13 Claims, 6 Drawing Sheets

TWO POSITION AT-REST SEAT ADJUSTMENT MECHANISM

BACKGROUND OF THE INVENTION

This invention relates generally to chair control mechanisms, and more particularly to a mechanism that allows the angle of a seat pan to be adjusted between two at rest positions.

Typical office chairs and the like are equipped with a seat plate to which the actual chair seat is attached. In most chairs, the seat and seat plate are oriented generally parallel to the surface on which the chair rests. In other words, the seat is generally horizontal. However, it may also provide more comfort for certain users or certain use situations to incline the seat slightly. The seat in such an arrangement is inclined so that the back of the seat is slightly higher that the front of the seat. This may be referred to as a "task position" or "computer position." The aim of such a position is to increase the comfort of users over long periods of time and to provide proper support for these task positions.

The present invention provides a feature for a chair that allows the seat to be placed in either of two distinct positions, a generally horizontal position and an inclined position. The assembly is of a relatively simple construction and is thus easily manufactured. Such a simplistic approach also reduces costs and is more intuitive to the users of the chair.

SUMMARY OF THE INVENTION

Accordingly, the present invention provides a two-position, at rest, seat angle adjustment assembly that allows the seat angle on a chair to be varied between two distinct positions. The assembly is attached to a J-back adjustment assembly and a first plate of a tilt-control mechanism. A second plate is slidably coupled with the first plate, and a seat is coupled with the second plate.

The two-position, at rest, seat angle adjustment assembly moves the second plate and, thus, the seat between two distinct positions. In a first position, the seat is generally horizontal, while in a second position, the seat is inclined at an angle relative to horizontal. While many angles are possible, the preferred angle of inclination is five degrees. The assembly includes left and right adjustment mechanisms, a rod, and a lever. The left and right adjustment mechanisms are mirror images of one another. The left and right adjustment mechanisms are respectively mounted to the first plate and the J-back assembly on each side. Each of the adjustment mechanisms includes a housing, and a cam. The cam includes an inner cam and a collar. The inner cam is an eccentric cam that is received in a cam working area. The collar is received within a portion of the inner cam and an aperture in each sidewall of the J-back assembly. The rod is placed within a keyway in the collar and the inner cam and extends within the J-back assembly between the left and right adjustment mechanisms. The lever is attached to the rod proximate the right adjustment mechanism. The lever is utilized to rotate the cams within their respective housings thereby moving the first plate with respect to the J-back assembly.

As the eccentric cams are rotated, the seat moves between a first, generally horizontal position and a second, inclined position. The cams can be locked in either of these positions.

Additional aspects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means, instrumentalities and combinations particularly pointed out in the appended claims.

BRIEF DESCRIPTION OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
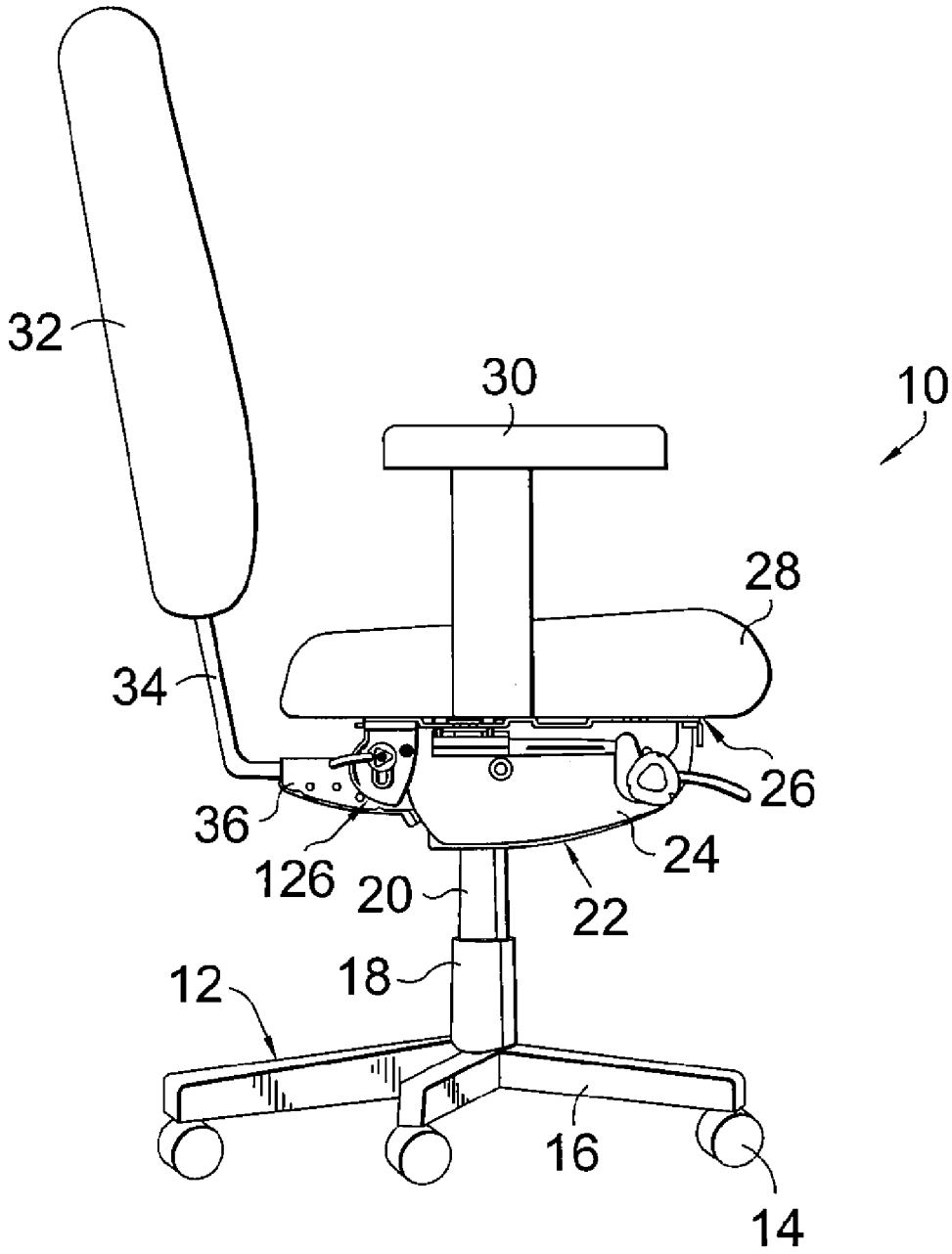
FIG. 1 is a perspective view of a chair of the present invention showing a two-position, at rest, seat angle adjustment assembly and a seat slider attached to a tilt control mechanism.

With initial reference to FIG. 1, a chair embodying the principles of the invention is generally indicated by reference numeral 10. The chair 10 is equipped with a base assembly 12. The base assembly 12 preferably has a number of casters 14 operably supported on the outer ends of a corresponding number of support legs 16. The support legs 16 converge to a pedestal column 18. Preferably, the pedestal column 18 and the support legs 16 are integrally formed in one piece. The column 18 preferably supports a gas cylinder 20. As is known to those of skill in the art, the gas cylinder 20 allows the height of the chair 10 to be adjusted by an occupant. The construction of the base 12 and column 18 is well known to those of skill in the chair industry.

Figure 2:
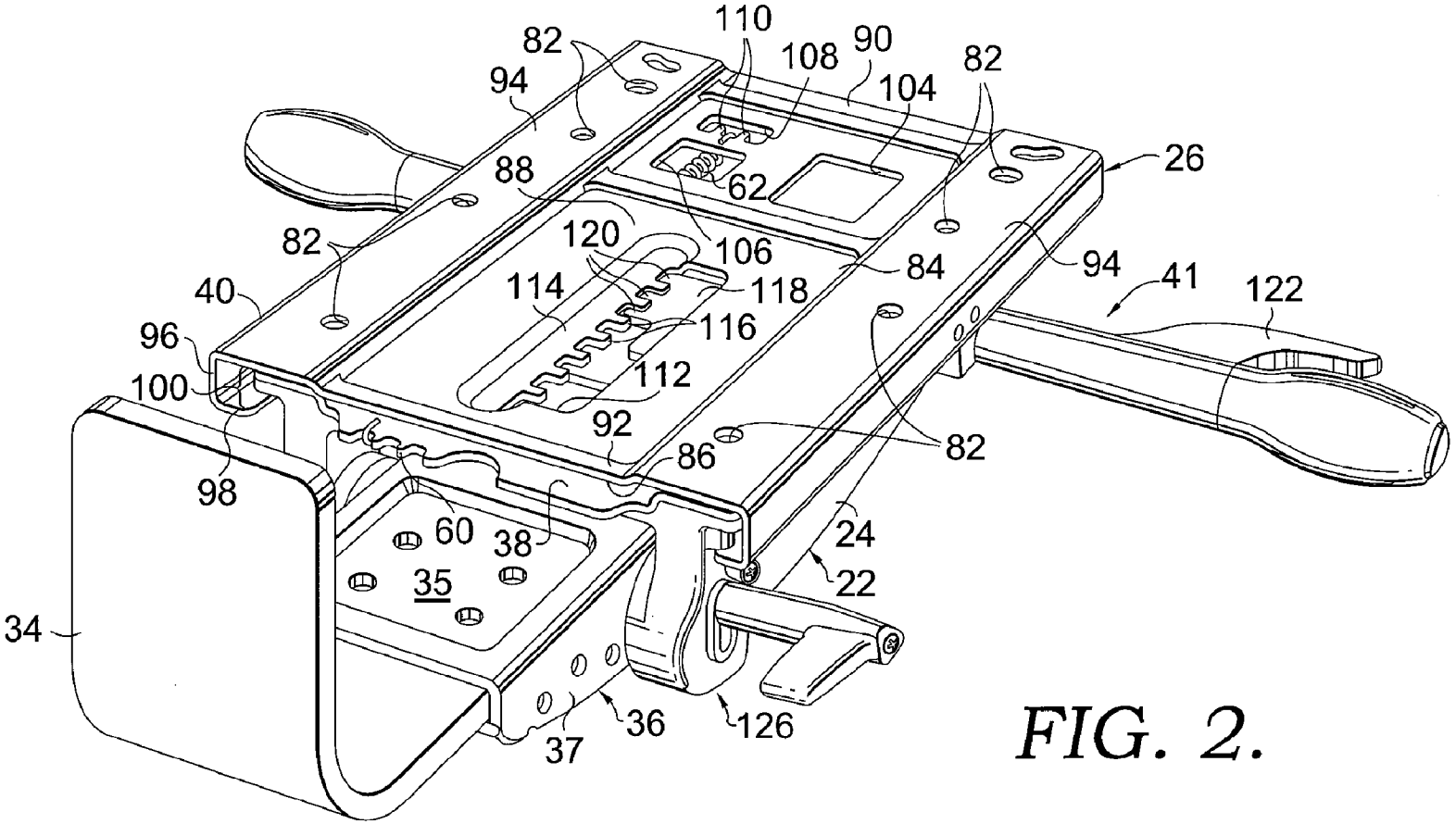
FIG. 2 is a perspective view of the two-position, at rest, seat angle adjustment assembly and the seat slider attached to the tilt control mechanism.

Referring now to FIGS. 1 and 2, a tilt control mechanism 22 is shown coupled to the gas cylinder 20. It is understood by one of ordinary skill in the art that the tilt control mechanism 22 contains a housing 24 and various internal parts that control the tilt of the chair 10. The internal portions are described in detail in U.S. Pat. No. 7,014,262, the contents of which are incorporated by reference. The tilt control mechanism 22 optionally supports a seat-depth adjustment mechanism 26. Specifically, the seat 28 is coupled to the seat-depth adjustment mechanism 26 which is, in turn, coupled to the tilt control mechanism 22. As stated above, the seat-depth adjustment mechanism is optional, and does not need to be present to practice the invention disclosed herein. If the adjustment mechanism is not used, the seat plate is coupled directly to the seat. The tilt control mechanism 22 includes a hole in its bottom, not shown, that accommodates an upper portion of gas cylinder 20. The upper portion of cylinder 20 is then secured to tilt control mechanism 22 so that as the cylinder 20 extends and retracts, the tilt control mechanism 22 correspondingly moves up and down. Preferably, this coupling is accomplished via a tapered bushing, as is known to those of skill in the art. A pair of armrests 30 and a chair back 32 are also coupled to the tilt control mechanism 22. Coupling of the chair back 32 to the tilt control mechanism 22 is accomplished by a J-back support bar 34 and a J-back adjustment assembly 36. The J-back adjustment assembly 36 contains an upper plate 35 and a pair of downwardly depending sidewalls 37 each having an aperture 39, as shown in FIG. 5.

Referring again to FIGS. 1 and 2, for the sake of completeness, the optional seat-depth adjustment mechanism 26 will be discussed. The seat-depth adjustment mechanism 26 is disclosed in U.S. patent application Ser. No. 11/210,299, Publication No. US-2006-0071525-A1, ("the '299 application"), the contents of which are incorporated by reference. The seat-depth adjustment mechanism 26 is affixed to the tilt control mechanism 22. The tilt control mechanism 22 typically operationally couples the base 12, the seat 28, and the back 32, as known to those of skill in the art. The seat-depth adjustment mechanism 26 includes a first plate 38, a second plate 40, and a lever mechanism 41. The second plate 40 is slidably coupled to the first plate 38 which is in turn coupled to the tilt control mechanism 22 as is further discussed below. The lever mechanism 41 controls the fore to aft relationship between the second and first plates 40, 38.

Figure 5:
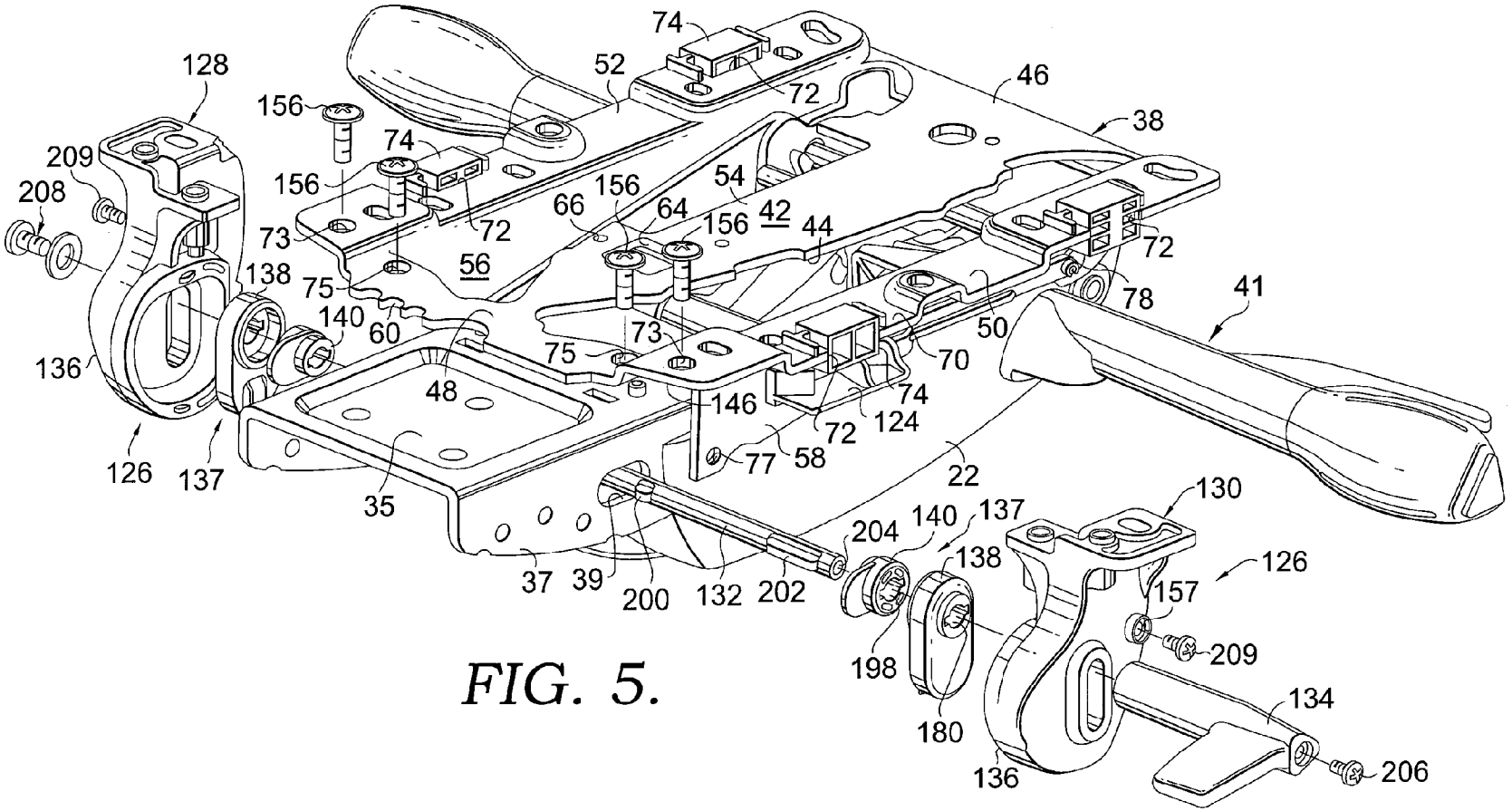
FIG. 5 is a view similar to FIG. 2 but with the two-position, at rest, seat angle adjustment assembly exploded to show detail.

Referring now to FIG. 5, the first plate 38 will be discussed. The first plate 38 is generally planar, presenting top and bottom surfaces 42, 44, front 46, rear 48 and side edges 50, 52, a central portion 54, and a pair of sidewalls 56, 58. The first plate 38 is preferably made from stamped steel, although any suitable material may be used. The rear edge 48 contains a plurality of projections 60 used to couple a spring 62, shown in FIG. 2, to the second plate 40. The central portion 54 contains a generally rectangular opening 64 and an aperture 66. The rectangular opening 64 receives a portion of the lever mechanism 41, while the aperture 66 is used to couple a spring, not shown, to a portion of the lever mechanism 41. Each of the sidewalls 56, 58 is formed from a separate cutout of the central portion 54 and depend downwardly therefrom, thereby providing a pair of openings located between the side edges 50, 52. The side edges 50, 52 depend outwardly from the central portion 54 and are connected thereto by the front and rear edges 46, 48. Each of the side edges 50, 52 is partially stepped to present a raised profile portion. The side edges 50, 52 further include a surface 70 that is aligned in the same plane as the central portion 54. The side edges 50, 52 are used to slidably couple the first plate 38 to the second plate 40. The side edges 50, 52 and rear edge 48 each contain a pair of attachment apertures 73, 75, the purpose of which will be discussed further below. As best seen in FIG. 5, each sidewall 56,58 has a hole 77, the purpose of which is described below. Each of the side edges 50, 52 further contains a pair of recesses 72, each of which receives a guide block 74. While not shown it should be understood that the guide blocks 74 facilitate sliding movement between the second plate 40 and the first plate 38. Specifically, the guide blocks 74 are placed within the recesses 72 to provide a layer of material between the first plate 38 and the second plate 40 to facilitate movement therebetween. While any suitable material for the guide blocks 74 may be used, the guide blocks 74 are preferably made from a durable, low-friction material such as polyethylene, polypropylene, acethalic resin or nylon that facilitates the sliding action of the top plate.

The second plate 40 is illustrated in FIG. 2 and includes a plurality of mounting holes 82 near the perimeter thereof which facilitate fastening the plate 40 to the bottom of the seat 28. The second plate 40 is preferably made from stamped steel, although any suitable material may be used. The second plate 40 is generally planar, presenting top and bottom surfaces 84, 86, a central portion 88, and front, rear and side edges 90, 92, 94. Each of the side edges 94 is stepped to present a raised profile portion in which the mounting holes 82 are formed for receiving fasteners to attach the second plate 40 to the seat 28. The raised profile portions are raised above the central portion 88 of second plate 40. The raised profile portions further include a downward protrusion 96. The downward protrusion 96 contains an inwardly projecting portion 98 that creates a C-shaped cross section 100. While not shown, it should be understood that the C-shaped cross-section 100 receives the guide blocks 74 on the first plate 38. Specifically, as stated above, the guide blocks 74 are placed in the recesses 72 of the first plate 38 and then are positioned within the C-shaped cross section 100 of the second plate 40. Thus, the guide blocks 74 provide a layer of material between the first plate 38 and the second plate 40 to facilitate movement therebetween. The second plate 40 also contains a pair of stops, not shown, located at a rearward portion of the C-shaped cross-section 100 that serve to limit the overall travel of the second plate 40 with respect to the first plate 38.

Referring again to FIG. 2, the mounting holes 82 are preferably arranged in a pattern corresponding to that of the mounting holes of the seat 28 such that the seat-depth adjustment mechanism 26 may be mounted to the seat 28 without requiring modification. Preferably, multiple sets of mounting holes 82 are formed in the second plate 40 so that the seat 28 may be assembled on the seat-depth adjustment mechanism 26 in multiple fore-to-aft positions. However, it is possible to form the plate 40 with only a single set of mounting holes 82 if desired.

The central portion 88 contains a pair of generally rectangular openings 104, 106 and an M-shaped opening 108 with a plurality of projections 110 located proximate the front edge 90. The projections 110 serve to attach a spring 62 connected to the projections 60 of first plate 38 to bias the second plate 40 with respect to the first plate 38. The central portion 88 also contains an opening 112 and a lowered profile rack 114 that is oriented in parallel with the line of motion of the second plate 40. The opening 112 is generally rectangular, formed adjacent the rack 114 and allows for mating with a portion of the lever mechanism 42. The rack 114 is shaped as shown and contains a plurality of teeth 116. Additionally, the length of rack 114, and the number of teeth 116 therein, is determined by the number of discrete positions desired by the manufacturer of the seat-depth adjustment assembly 26. For example, as shown in FIG. 2, the rack 114 can be of a length allowing six discrete positions.

As shown in FIGS. 2-5, the lever mechanism 41, disclosed in U.S. patent application Ser. No. 11/210,299, Publication No. US-2006-0071525-A1 contains a pawl 118 with a plurality of teeth 120, a paddle arm 122, and a cam linkage 124. While the lever mechanism is shown on the right hand side, with the seat height adjustment lever on the left in the Figures, it should be understood that these two levers and their corresponding parts can be reversed, such that the lever mechanism 41 and its corresponding parts are on the left side of tilt control mechanism 22. The teeth 120 of the pawl 118 mate with the teeth 116 of the rack 114. As such, when the paddle arm 122 of the lever mechanism 41 is turned, the cam linkage 124 moves the pawl 118 causing the teeth 120 of the pawl 118 to engage and disengage with the teeth 116 of the rack 114. In the engaged position, the second plate 40 is not allowed to move with respect to the first plate 38. In the disengaged position, the second plate 40 and the chair seat 28 are allowed to move with respect to the first plate 38. As such, the depth of the seat 28 with respect to the base 12 and chair back 32 may be adjusted. The engagement and disengagement of the teeth 120 of the pawl 118 with the teeth 116 of the rack 114 allow the second plate 40 to be adjusted with respect to the first plate 38.

Figure 3:
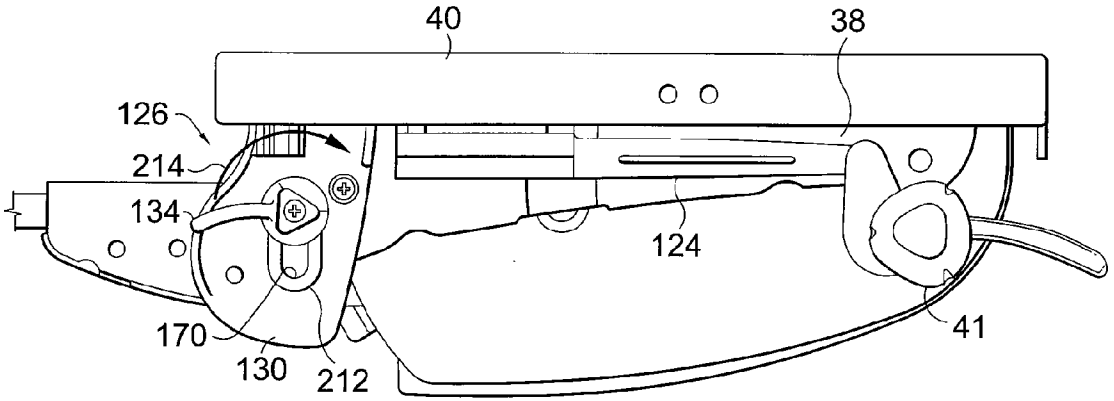
FIG. 3 is a side view showing the two-position, at rest, seat angle adjustment assembly in a first position.
Figure 4:
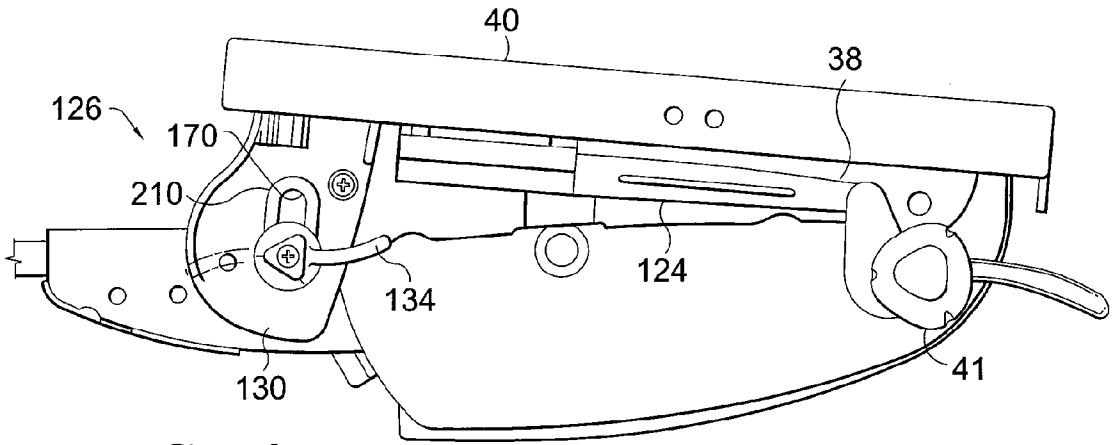
FIG. 4 is a view similar to FIG. 3 but showing the two-position, at rest, seat angle adjustment assembly in a second position.

As shown in FIGS. 1 and 2, the chair further includes a two-position at rest, seat angle adjustment assembly 126. The two-position at rest, seat angle adjustment assembly 126 locks the second plate 40 and, thus, the seat 28 in two distinct positions. In a first position, the second plate 40 is generally horizontal, as best seen in FIG. 3. In a second position, the second plate 40 is inclined at a five degree angle relative to horizontal, as best seen in FIG. 4. As seen in FIG. 2, the assembly 126 is coupled to both the J-back assembly 36 and the first plate 38.

Figure 6:
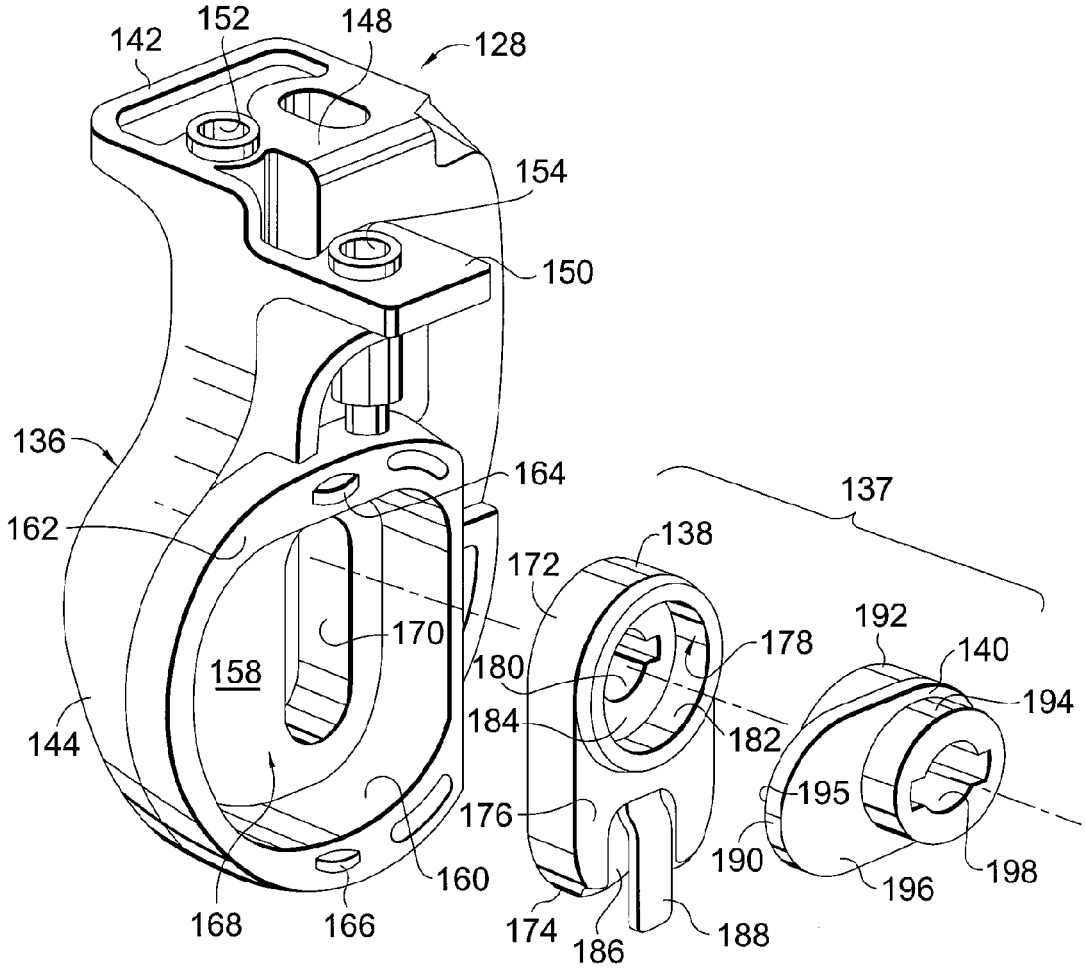
FIG. 6 is an enlarged, exploded view of a left adjustment mechanism of the two-position, at rest, seat angle adjustment assembly.
Figure 7:
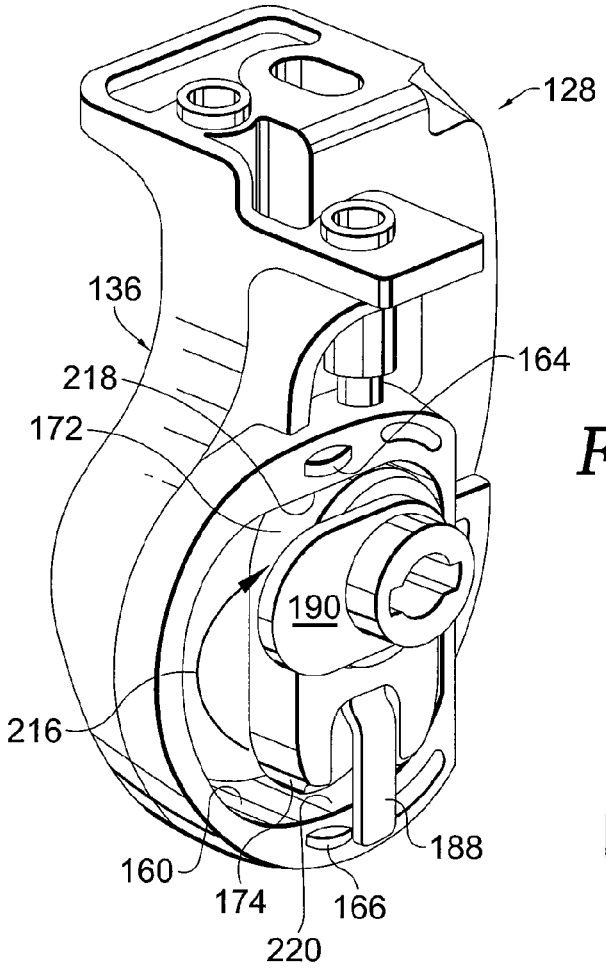
FIG. 7 is an enlarged view of the left adjustment mechanism of the two-position, at rest, seat angle adjustment assembly in the first position.
Figure 8:
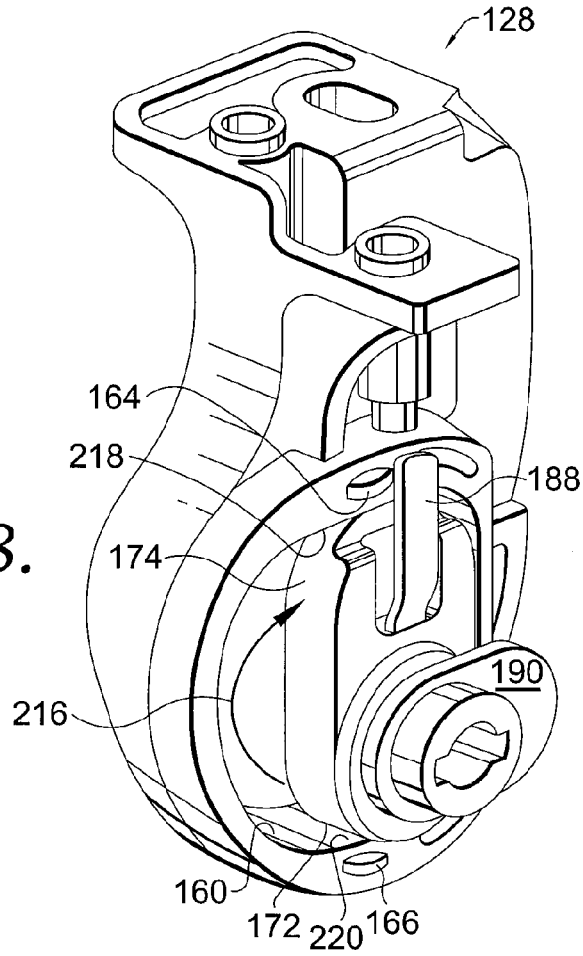
FIG. 8 is an enlarged view of the left adjustment mechanism of the two-position, at rest, seat angle adjustment assembly in the second position.

As shown in FIGS. 5 and 6, the assembly 126 includes left and right adjustment mechanisms 128, 130, a rod 132, and a lever 134. The left and right adjustment mechanisms 128, 130 are mirror images of one another. Each of the mechanisms 128, 130 includes a housing 136 and a cam 137. FIGS. 6-8 show the left mechanism 128 and it should be understood that the components discussed below are found in both the left and right adjustment mechanisms 128, 130. The housing 136 includes a mounting portion 142 and a cam working area 144. The mounting portion 142 is shaped as shown and mates with an underside 146 of the first plate 38. The mounting portion 142 contains an upper portion 148 and a tab 150, each having a threaded aperture 152, 154 that aligns with the apertures 73, 75 in the first plate 38 and receives bolts 156 to mount the housing 136 to the first plate 38. As seen in FIG. 5, the housing also contains a capped hole 157 to facilitate attachment as described below. The cam working area 144 is shaped as shown and includes a wall 158, an inner cam surface 160, and an outer surface 162. The outer surface 162 contains top and bottom tabs 164, 166 that are used to lock the inner cam 138 in place so that it cannot rotate, as will be further discussed below. The inner cam surface 160 and the wall 158 combine to create a cam cavity 168 with a cross-section that receives the inner cam 138, as shown in FIGS. 7 and 8. The wall 158 further includes an elongate aperture 170, the purpose of which will be discussed further below.

Referring again to FIG. 6, the cam 137 will be discussed. The cam 137 contains an inner cam 138 and a collar 140. The inner cam 138 is an eccentric cam containing first and second rounded ends 172, 174 and an elongate middle section 176 that extends therebetween. The first rounded end 172 includes first and second inner bores 178, 180. The first bore 178 contains an inner wall 182 and a wall 184. The second inner bore 180 is a keyway located in the wall 184 of the first inner bore 178. The second rounded end 174 contains a recess 186 and a finger 188 that projects therefrom. The finger 188 along with the top and bottom tabs 164, 166 locks the inner cam 138 in place so that it cannot rotate, as further described below.

The collar 140 includes an oblong tab 190, a bore collar 192, and a wall collar 194. The bore collar 192 projects outwardly from a first side 195 of the oblong tab 190 while the wall collar 194 projects outwardly from a second side 196 of the oblong tab 190. A keyway bore 198 extends through each of the oblong tab 190, bore collar 192, and wall collar 194.

Referring now to FIG. 5, the rod 132 will be discussed. The rod 132 contains a pair of mating keys 200 (only one is shown), a lever key 202, and a pair of threaded ends 204 (only one is shown). The mating keys 200 are spaced apart along the rod 132 and are designed to be received in the keyways 180, 198 of the inner cam 138 and collar 140, respectively. The lever 134 is received on the lever key 202 and is coupled to the threaded end 204 of the rod 132 by a bolt 206.

Referring now to FIGS. 5-8 the assembly of the two-position, at rest, seat angle adjustment assembly 126 will be discussed. FIG. 6 shows an exploded view of the left mechanism 128 while FIGS. 7 and 8 show assembled views. First, the assembly of the left mechanism 128 will be discussed. Additionally, it should be understood that the assembly of the left and right mechanisms 128, 130 are the same.

Referring now to FIG. 6, first, the bore collar 192 of the collar 140 is placed within the first inner bore 178 of the inner cam 138 to assemble the cam 137. Next, the cam 137 is placed within the cam cavity 168 of the cam working area 144 of the housing 136. At this time assembly of the left and right mechanisms 128, 130 is complete.

Next, the rod 132 is placed within apertures 39 in the sidewalls 37 of the J-back adjustment assembly 36 such that the ends of the rod 132 project therefrom. The left and right adjustment mechanisms 128, 130 are then placed on the ends of the rod 132 such that the rod 132 is placed in the elongate aperture 170 in the right mechanism 130, through the keyway 180 in the inner cam 138 and the keyway 198 in the wall collar 194 of collar 140 that is received in the sidewall 37 of the J-back adjustment assembly 36. The mating keys 200 align and are received within the keyways 180, 198 of the inner cam 138 and collar 140. The lever 134 is then placed on the lever key 202 and coupled to the threaded end 204 of the rod 132 by bolt 206 proximate the right mechanism 130. Next, a bolt and washer 208 are placed within the opposite threaded end of the rod 132, not shown, proximate to the left mechanism 128. Bolts 156 are placed through the apertures 73, 75 in the first plate 38 and threaded into threaded apertures 152, 154 in the upper portion 148 and tab 150 of the housing 136 of each of the left and right mechanisms 128, 130. Self-threading screws 209 are placed through holes 157 and threaded into holes 77 to further hold housing 136 in place.

Referring now to FIGS. 3, 4, 7 and 8, the operation of the of the two-position, at rest, seat angle adjustment assembly 126 will be discussed. FIGS. 3 and 7 show the two-position, at rest, seat angle adjustment assembly 126 in the first, generally horizontal position. FIGS. 4 and 8 show the two-position, at rest, seat angle adjustment assembly 126 in the second, inclined position. In the first position, the finger 188 is located proximate the lower bottom tab 166 while the rod 132 is located at an upper end 210 of the elongate slot 170. Further, the first rounded 172 end is located proximate an upper portion 218 of the inner cam surface 160 while the second rounded 174 end is located proximate a lower portion 220 of the inner cam surface 160.

To move the assembly 126 from the first position to the second position, the lever 134 is turned in a clockwise manner, shown by reference numeral 214. As the lever 134 is rotated clockwise, the second rounded end 174 rotates with the rod 132. As pressure is applied, finger 188 moves past tab 166. The second end 174 of the cam then moves from the lower portion 220 of the inner cam surface 160 to the upper portion 218 of the inner cam surface 160, as shown by arrow 216. This exerts an upward force, causing the rear portion 48 of the first plate 38 to move upwardly. Additionally, as the lever 134 and rod 132 rotate, the first rounded end 172 moves downwardly with respect to housing 136 from the upper portion 218 of the inner cam surface 160 to the lower portion 220 of the inner cam surface 160. As the rod 132 rotates, it is allowed to translate within aperture 39, moving from a more forward position to a more rearward position. As shown in FIG. 7, tab 190 is positioned to cover the open area of aperture 39 when in the first position. As the cam rotates to the second position of FIG. 8, tab 190 also rotates to cover the newly open area of aperture 39.

In the second position, as shown in FIG. 8, the finger 188 is engaged with the top tab 164 while the rod 132 is located at the lower end 212 of the elongate slot 170. Further, the first rounded end 172 is located proximate the lower portion 220 of the inner cam surface 160 while the second rounded end 174 is located proximate the upper portion 218 of the inner cam surface 160. The finger 188 along with the tabs 166, 164 serve to lock the assembly 126 in the first and second positions, respectively.

Therefore, by simple movement of lever 134, the seat is easily moved between two distinct at rest positions. The mechanism described takes little additional space, and is of a relatively simple construction.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seat angle adjustment assembly for use with a chair tilt mechanism, the tilt mechanism including a housing, a back attachment assembly coupled to the housing, and a seat plate adapted to be coupled to a chair seat and pivotably coupled at a front end to the housing, the seat angle adjustment assembly comprising:

a rod rotatably coupled to the back attachment assembly;

a first cam housing coupled to the seat plate on a first side of the back attachment assembly and a second cam hosing coupled to the seat plate on a second side of the back attachment assembly, the first cam housing defining a first cam cavity and the second cam housing defining a second cam cavity;

a first cam located within the first cam cavity and a second cam located within the second cam cavity, the first cam and the second cam each defining at least two positions, wherein the rod is coupled to the first cam and the second cam and rotates together with the first cam and the second cam; and wherein a portion of the first cam is received in a slot in a first sidewall of the back attachment assembly and a portion of the second cam is received in a slot in a second sidewall of the back attachment assembly; and a lever coupled to the rod such that rotation of the lever rotates the rod and the first cam and the second cam, wherein rotation of the lever rotates the first cam within the first cavity to move the first cam between the at least two positions and rotates the second cam within the second cavity to move the second cam between the at least two positions, thus moving the cam housings and rear of the seat plate between two positions.

2. The seat angle adjustment assembly of claim 1, wherein each cam housing includes an elongate slot positioned adjacent the cam cavity, the slot allowing movement of said rod as the lever moves the cam, and thus the cam housings and rear of the seat plate between the two positions.

3. The seat angle adjustment assembly of claim 1, wherein each cam includes a cam collar and an eccentric cam keyed to the rod, the cam collar being held within the slot in the back attachment assembly, and the eccentric cam being held within the cam cavity.

4. The seat angle adjustment assembly of claim 3, wherein in a position of the at least two positions, a the first rounded end is located at a lower portion of an inner cam surface and a second rounded end is located at an upper portion of the inner cam surface.

5. The seat angle adjustment assembly of claim 4, wherein the eccentric cam is an elongate-oval shape, with the rod keyed proximate one end of the oval-shape.

6. The seat angle adjustment assembly of claim 5, wherein the eccentric cam has a spring finger extending outwardly away from the end of the cam keyed to the rod, and wherein the cam housing includes a pair of protruding tabs, the finger and one respective tab operable to hold the seat adjustment assembly in one of the two positions.

7. The seat height adjustment assembly of claim 6, wherein a first position of the two positions orients the seat plate generally horizontally and a second position of the two positions orients the seat plate at an angle with the rear of the seat higher than the front of the seat.

8. A seat angle adjustment assembly for use with a chair having a base, a tilt control mechanism supported by the base which allows a seat to be tilted relative to the base, the tilt control mechanism having a main body and a seat plate pivotably coupled to a front portion of the main body, the seat being supported by the seat plate, and a back coupled to the tilt control mechanism by a back assembly, the assembly comprising;

a pair of adjustment mechanisms, each of the pair of adjustment mechanisms being coupled with the back assembly and located outwardly therefrom, each of the adjustment mechanisms including:

a housing coupled with a rear portion of the seat plate, the housing including a cam cavity with an inner cam surface, an elongate slot, and first and second stops, a cam received within the housing, the cam including a keyed aperture, wherein the cam includes a first end keyed to the rod and a second end having an extending finger, the finger operable with said first and second stops to hold the seat plate in first and second positions relative to the chair base, and a rod fixedly received within the keyed aperture and interconnecting the pair of adjustment mechanisms such that rotation of said rod rotates said cams within said housings, wherein rotation of said cams causes the housings to move, and in turn causes the rear of the seat plate to pivot about the front of the seat plate.

9. The seat angle adjustment assembly of claim 8, wherein in the first position the first end is located at an upper portion of the inner cam surface, the second end is located at a lower portion of the inner cam surface, and the extending finger is in contact with the second stop.

10. The seat angle adjustment assembly of claim 9, wherein in the second position the first end is located at the lower portion of the inner cam surface, the second end is located at the upper portion of the inner cam surface, and the extending finger is in contact with the first stop.

11. The seat angle adjustment assembly of claim 10, wherein in the first position the seat plate is oriented generally horizontally and in the second position the seat plate is inclined at an angle such that the rear of the seat is higher than the front of the seat.

12. A two position seat angle adjustment mechanism for use on a chair having a seat plate with a forward end pivotably coupled to a tilt control mechanism, comprising:

a rod;

a lever coupled to the rod such that rotation of the lever rotates the rod;

a cam housing coupled to the rod, the cam housing having a stop tab protruding from a cam-housing surface, wherein rotation of the lever and the rod does not rotate the cam housing; and a cam coupled to the rod and positioned inside the cam housing, the cam including a protruding finger, wherein rotation of the lever and the rod rotates the cam through a plurality of positions and wherein the protruding finger engages the stop tab to hold the cam in one position of the plurality of positions.

13. The seat angle adjustment mechanism of claim 12 further comprising a plurality of stop tabs protruding from the cam-housing surface, wherein the plurality of stop tabs selectively hold the seat plate in each of the plurality of positions.

* * * * *